US007351078B2

(12) United States Patent
Winkler et al.

(10) Patent No.: US 7,351,078 B2
(45) Date of Patent: Apr. 1, 2008

(54) CONNECTOR ARRANGEMENT

(75) Inventors: Markus Winkler, Erlangen (DE); Armin Deinzer, Schnait-Tach (DE)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/518,947

(22) PCT Filed: Jun. 17, 2003

(86) PCT No.: PCT/EP03/06383

§ 371 (c)(1),
(2), (4) Date: Jul. 14, 2005

(87) PCT Pub. No.: WO04/001910

PCT Pub. Date: Dec. 31, 2003

(65) Prior Publication Data

US 2006/0009057 A1 Jan. 12, 2006

(30) Foreign Application Priority Data

Jun. 20, 2002 (DE) ..... 102 27 591

(51) Int. Cl.
*H01R 13/62* (2006.01)

(52) U.S. Cl. ..... 439/157

(58) Field of Classification Search ..... 439/157, 439/160, 372, 347, 266, 488–489, 752, 595, 439/701, 345, 352, 152, 154–156, 341–343
See application file for complete search history.

(56) References Cited

U.S. PATENT DOCUMENTS

| | | | | |
|---|---|---|---|---|
| 6,162,072 | A * | 12/2000 | Hoyer et al. | 439/157 |
| 6,213,795 | B1 * | 4/2001 | Drescher et al. | 439/157 |
| 6,217,354 | B1 | 4/2001 | Fencl et al. | 439/157 |
| 6,305,957 | B1 | 10/2001 | Fink et al. | 439/157 |
| 6,475,004 | B2 * | 11/2002 | Shuey et al. | 439/157 |
| 6,652,298 | B2 * | 11/2003 | Ohnuki | 439/157 |
| 6,824,406 | B1 * | 11/2004 | Sharples et al. | 439/157 |

FOREIGN PATENT DOCUMENTS

| | | |
|---|---|---|
| DE | 198 44 689 A1 | 3/2000 |
| DE | 198 44 693 A1 | 3/2000 |
| DE | 100 06 433 A1 | 8/2000 |
| DE | 102 27 591 B3 | 2/2004 |
| EP | 0 938 162 A2 | 8/1999 |
| EP | 1 005 112 A2 | 5/2000 |

* cited by examiner

*Primary Examiner*—Edwin A. Leon
(74) *Attorney, Agent, or Firm*—Harrington & Smith, PC

(57) ABSTRACT

The present invention relates to a connector arrangement with a first housing and a second housing, which receive a plug arrangement and a socket arrangement, respectively, and can be joined together by means of a cross slider which has guide frame ramps, and which is controlled by a pivoted lever mounted on a housing, wherein all guide frame slots or ramps and the bearing of the pivoted lever are open in the direction of plugging in order to make possible an insertion of the respective guide tabs or bearing tabs.

12 Claims, 3 Drawing Sheets

CONNECTOR ARRANGEMENT

BACKGROUND OF THE INVENTION

The present invention relates to a connector arrangement in accordance with the preamble of patent claim 1. Such connector arrangements are suitable particularly for insertion of plug faces with a large number of plug pins into each other, so that the required insertion force is large. By way of the cross slider with guide frame ramps, which is actuated by means of a pivoted lever, it is possible to facilitate the insertion by exploiting lever principles. The guide frame slots and guide tabs required for this are positioned, as a rule, on the widest lateral walls of the plug connectors, the guide tabs being introduced into the guide frame slots, which are closed at both ends, by elastic deformation of the lateral walls. When the guide tabs are seated in the slots, the lateral walls snap elastically back into their original position, so that the cross slider and/or the pivoted lever is/are mounted.

This procedure is not suitable for automatic assembly and the fabrication process is therefore lengthened and thus made more costly. The present invention is based on the problem of extensively improving a connector arrangement of this type in such a manner that it is suitable for mechanical assembly.

A solution to this problem is recited by the claim. Features of preferred embodiment examples are characterized in the subclaims.

SUMMARY OF THE INVENTION

The invention is based on the idea of designing all required guide frames to be open on one side, so that housing walls do not have to bend out for introduction of the guide tabs. Further measures and specific geometric arrangements of the open ends ensure that the guide tabs are not able to slip accidentally out of the guide frame slots.

BRIEF DESCRIPTION OF THE DRAWINGS

In the following, the invention will be explained in greater detail on the basis of the description of an embodiment example with reference to the drawing. Shown therein are.

DETAILED DESCRIPTION OF THE INVENTION

Figure 1:
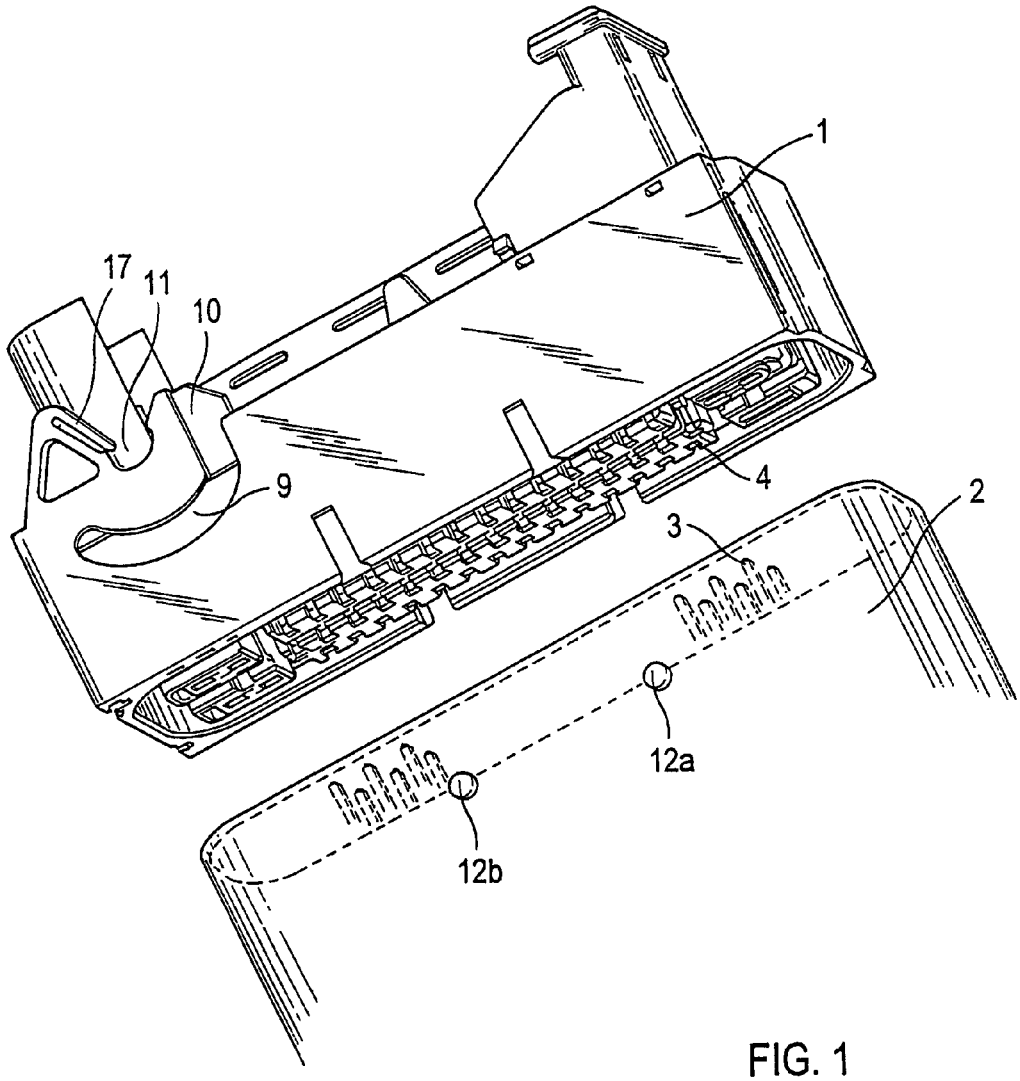
FIG. 1 two complementary housings of the connector arrangement of the invention.

Visible in FIG. 1 is a first housing 1, in which a socket arrangement 4 forms the plug face. Located on the back side of the housing 1 are the bearing sleeves 11 for receiving the bearing tabs 16 of the pivoted lever 5 and the circular segment guide frame [slots] 9. The circular segment guide frame [slots] 9 are open at one end through a straight extension in the direction opposite to the direction of plugging. Accordingly, the bearing sleeves 11 and the circular segment guide frame [slots] 9 are open toward the same side, so that the pivoted lever 5 can be introduced from behind in the direction of plugging with its guide tabs and bearing tabs 16, 18. The bearing sleeve 11 has, on one side, a spring arm 17 positioned at an angle to the direction of plugging, the free end of which is swung out of the way by the bearing tab when the latter is inserted in order to spring back into the initial position when the bearing tab 16 has reached its final position. In this way, the bearing tab 16 is locked in its final position.

Figure 2:
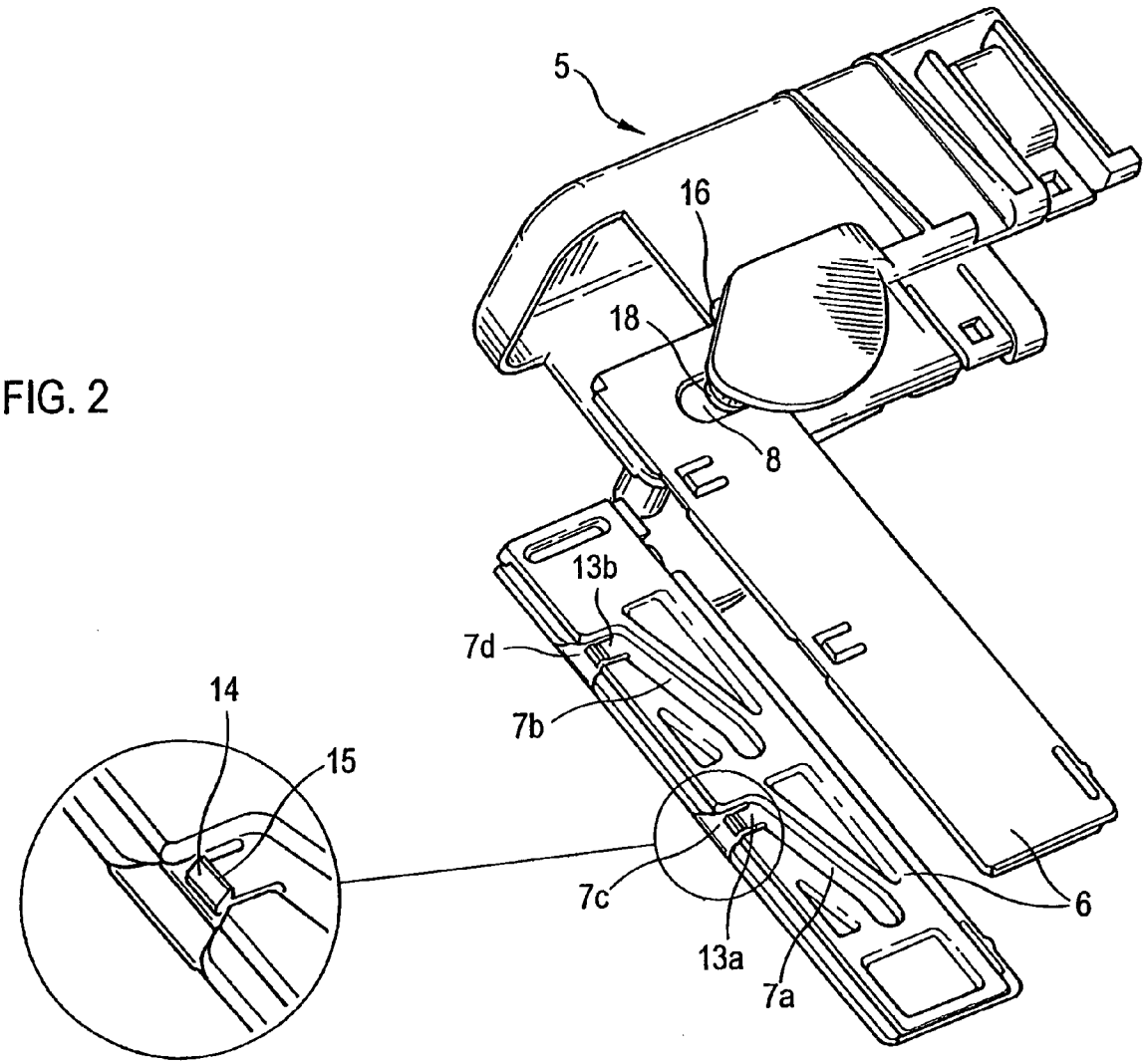
FIG. 2 the cross slider actuated by a pivoted lever.

The second housing 2 has a complementary arrangement of plug pins 3. Shown in addition are the guide tabs 12*a*, 12*b*, which are introduced into the corresponding guide frame slots 7*a*, 7*b* of the cross slider 6 shown in FIG. 2. The guide frame slots 7*a*, 7*b* of the cross slider 6 are also open in the direction of plugging, so that the guide tabs 12*a*, 12*b* can be introduced without deformation of the cross slider walls. The ramp-shaped guide frame slots 7*a*, 7*b*, in contrast to the circular segment guide frame slots 9, do not go all the way through as perforations, but rather only form grooves in the inner walls of the cross slider walls 6. Formed on the openings 7*c*, 7*d* are tongues with catch pieces 14, it being necessary during insertion for the guide tabs 12*a*, 12*b* to overcome the angled catch pieces in order to reach the guide frame ramps. In this way, the connection is designed to be more secure and it allows a rapid mechanical insertion of the connector parts into one another.

Figure 3:
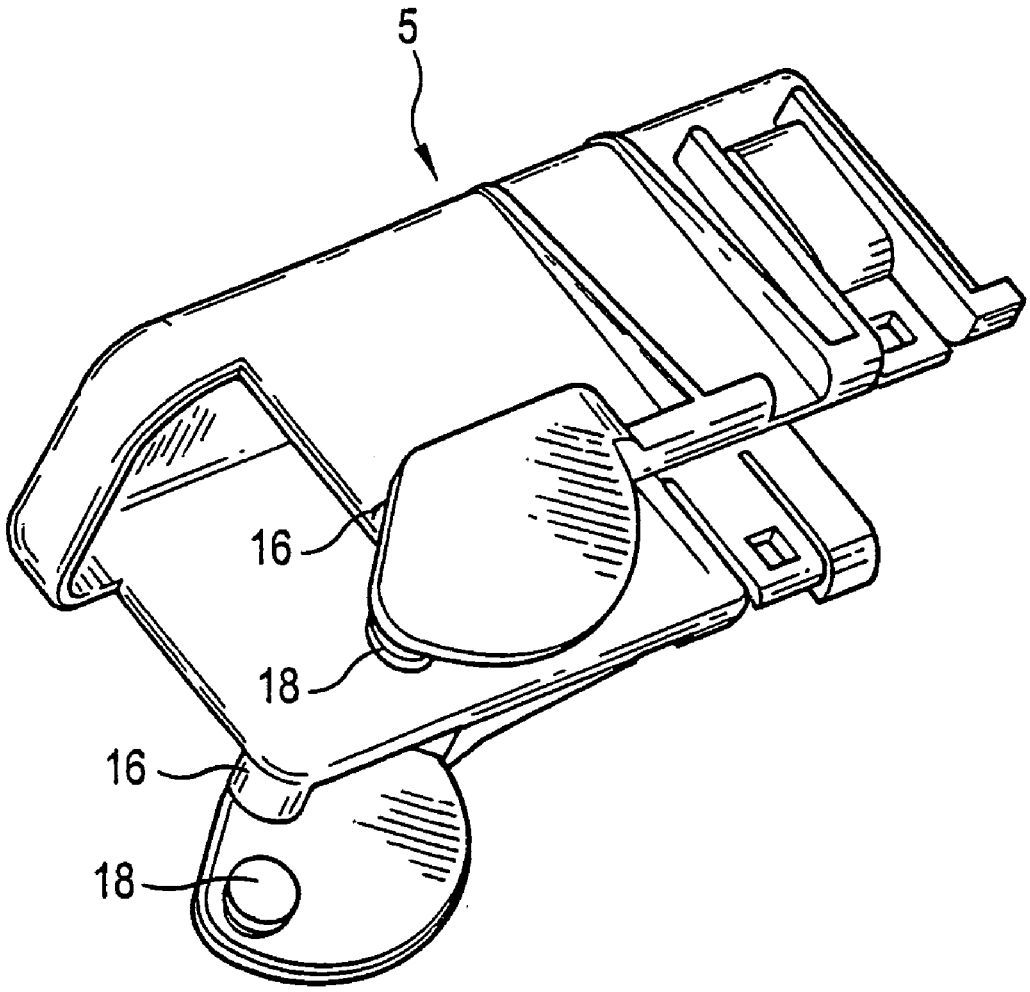
FIG. 3 the pivoted lever viewed in perspective.

FIG. 3 shows the pivoted lever 5 viewed in perspective. Evident are the bearing tabs 16 and the guide tabs 18, which are introduced into slots 8, slots 8 are positioned on the outer walls of the cross slider 6 and are open in the direction opposite to the direction of plugging, the bearing tab 16 and the guide tabs 18 move the cross slider transverse to the direction of plugging when the pivoted lever is twisted, whereby the guide tabs 12*a*, 12*b* travel up the ramps of the guide slots 7*a*, 7*b*, while, at the same time, the two plug connector housings 1, 2 are moved toward each other and the plug pins and plug sockets are inserted into one another.

The above description of an embodiment example of the present invention is not to be understood as being limiting, but rather serves only for explanation of the invention described in the claims.

The invention claimed is:

1. A connector arrangement with a first housing and a second housing, each of which receives a plug arrangement and a socket arrangement, respectively, wherein the first housing has bearing sleeves and the second housing has guide tabs, wherein the housings can be joined together by means of a cross slider which has a first slot and guide frame slots, which is controlled by a pivoted lever having a bearing tab and a guide tab, wherein the pivoted lever is mounted on the first housing, is hereby characterized in that the guide frame slots are open in the direction of plugging, in order to make possible an insertion of the respective second housing guide tabs, wherein the end of the guide frame slots of the cross slider situated toward the plugged end of the first housing has, in each case, an opening that is parallel to the direction of plugging for receiving the guide tabs arranged correspondingly on the second housing, wherein the bearing tabs of the pivoted lever are mounted in the bearing sleeves of the first housing, wherein the bearing sleeves are open in the direction opposite to the direction of plugging, wherein the first slot of the cross slider receives the lever guide tab, and wherein the first slot of the cross slider is parallel to the direction of plugging and open in the direction opposite to the direction of plugging.

2. The connector arrangement according to claim 1, further characterized in that first spring catch arms are formed, in each case, in a region of the opening.

3. The connector arrangement according to claim 2, further characterized in that, at its free end, the first catch arm has a catch piece dropping off at an angle to the opening, a back side of which has a catch shoulder for blocking the guide tab.

4. The connector arrangement according to claim 2, further characterized in that the openings of the guide frame slots widen toward the plugged end of the first housing.

5. The connector arrangement according to claim 1, further characterized in that the bearing tabs of the pivoted lever are secured by a second elastic spring arm, on one side of the bearing sleeve opening.

6. The connector arrangement according to claim 5, further characterized in that the second elastic spring arms are arranged on an attached piece of the first housing next to the bearing sleeves in such a way that their free end secures, in each case, the bearing tabs in the bearing sleeves.

7. The connector arrangement according to claim 6, further characterized in that the second elastic spring arms extend at an angle to the direction of plugging.

8. The connector arrangement according to claim 1, further characterized in that the first housing has a circular segment guide frame slot that is open in the direction opposite to the direction of plugging and in part concentric in relation to the bearing sleeve.

9. The connector arrangement according to claim 8, further characterized in that the open side of the circular segment guide frame slot extends parallel to the direction of plugging.

10. The connector arrangement according to claim 8, further characterized in that in an unactuated position of the pivoted lever, the first slot of the cross slider lies below the opening of the circular segment slot, in order to receive the respective guide tab of the pivoted lever.

11. A connector arrangement comprising:

a first housing having a back side and an opposing first contact, wherein the first housing comprises a bearing sleeve open to the back side of the first housing;

a second housing having a complementary second mating contact;

a cross slider disposed between the first housing and the second housing, wherein the cross slider comprises a slot having an open end, and wherein the open end is open to the back side of the first housing; and a lever having a bearing tab and a guide tab, wherein the bearing tab is configured to be received by the bearing sleeve when the bearing tab is inserted into the bearing sleeve at the back side of the first housing, and wherein the guide tab is configured to be insertable into the open end of the slot.

12. A connector arrangement comprising:

a first housing having a back side and an opposing first contact forming a plug face, wherein the first housing comprises a bearing sleeve and a spring arm, wherein the bearing sleeve is open to the back side of the first housing, and wherein a free end of the spring arm extends to a side of the bearing sleeve;

a second housing having a complementary second mating contact;

a cross slider disposed between the first housing and the second housing, wherein the cross slider comprises a slot having a closed end and an open end, wherein the closed end is adjacent to the plug face and the open end is adjacent to the back side; and a lever having a bearing tab and a guide tab, wherein the bearing sleeve is configured to receive the bearing tab, wherein the free end is configured to resiliently deflect and secure the bearing tab within the bearing sleeve, and wherein the slot is configured to receive the guide tab.

* * * * *